US008161595B1

(12) United States Patent
Wilson

(10) Patent No.: US 8,161,595 B1
(45) Date of Patent: Apr. 24, 2012

(54) VACUUM CLEANER WITH SCRUBBERS

(76) Inventor: Javan E. Wilson, Miami, FL (US)

( * ) Notice: Subject to any disclaimer, the term of this patent is extended or adjusted under 35 U.S.C. 154(b) by 1042 days.

(21) Appl. No.: 12/104,898

(22) Filed: Apr. 17, 2008

(51) Int. Cl.
*A47L 7/00* (2006.01)

(52) U.S. Cl. ..... 15/320; 15/327.1; 15/327.2; 15/412

(58) Field of Classification Search ..... 15/320, 15/327.1, 327.2, 412; *A47L 7/00*
See application file for complete search history.

(56) References Cited

U.S. PATENT DOCUMENTS

| | | | | |
|---|---|---|---|---|
| 3,931,662 | A | 1/1976 | Nayfa et al. | |
| 3,992,747 | A | 11/1976 | Hufton | |
| 4,173,056 | A | 11/1979 | Geyer | |
| 5,319,828 | A | 6/1994 | Waldhauser et al. | |
| 5,369,838 | A | 12/1994 | Wood et al. | |
| 5,455,982 | A | 10/1995 | Armstrong et al. | |
| 6,279,196 | B2 * | 8/2001 | Kasen et al. | 15/320 |
| 6,490,755 | B2 | 12/2002 | Paterson et al. | |
| 7,757,342 | B2 * | 7/2010 | Gordon et al. | 15/320 |
| 7,979,955 | B2 * | 7/2011 | Lenkiewicz et al. | 15/327.2 |
| 2002/0174510 | A1 | 11/2002 | Thatcher et al. | |
| 2005/0050672 | A1 | 3/2005 | Lenkiewicz et al. | |

* cited by examiner

*Primary Examiner* — David Redding

(57) ABSTRACT

This patent discloses and electrical appliance device to scrub clean a floor using a cleaning solution and to collect resulting dirty water from the floor. The electrical appliance device may include an upright portion attached to a handle assembly and a horizontal portion connected at a bottom of the upright portion, where the upright portion may be configured to pivot relative to the horizontal portion. A dirty water reservoir may be connected to the upright portion. The horizontal portion may include brushes, a brush motor, a suction pipe, a suction bar, and a solution reservoir having a brush motor cavity formed within a lower side of the solution reservoir. The brush motor may reside within and be surrounded by the brush motor cavity.

17 Claims, 7 Drawing Sheets

VACUUM CLEANER WITH SCRUBBERS

BACKGROUND

1. Field

The information disclosed in this patent relates to a vacuum cleaner with scrubbers.

2. Background Information

A vacuum cleaner is a device that uses an air pump to create a partial vacuum to suck up dust and dirt from carpeted floors. Most homes with carpeted floors in possess a domestic vacuum cleaner for cleaning. The dirt is collected by a filtering system or a cyclone for later disposal. However, vacuum cleaners lack ability to clean tile and grout, as well as carpet effectively. What is needed is a vacuum cleaner to overcome these and other problems.

SUMMARY

This patent discloses and electrical appliance device to scrub clean a floor using a cleaning solution and to collect resulting dirty water from the floor. The electrical appliance device may include an upright portion attached to a handle assembly and a horizontal portion connected at a bottom of the upright portion, where the upright portion may be configured to pivot relative to the horizontal portion. A dirty water reservoir may be connected to the upright portion. The horizontal portion may include brushes, a brush motor, a suction pipe, a suction bar, and a solution reservoir having a brush motor cavity formed within a lower side of the solution reservoir. The brush motor may reside within and be surrounded by the brush motor cavity.

DETAILED DESCRIPTION

Figure 1:
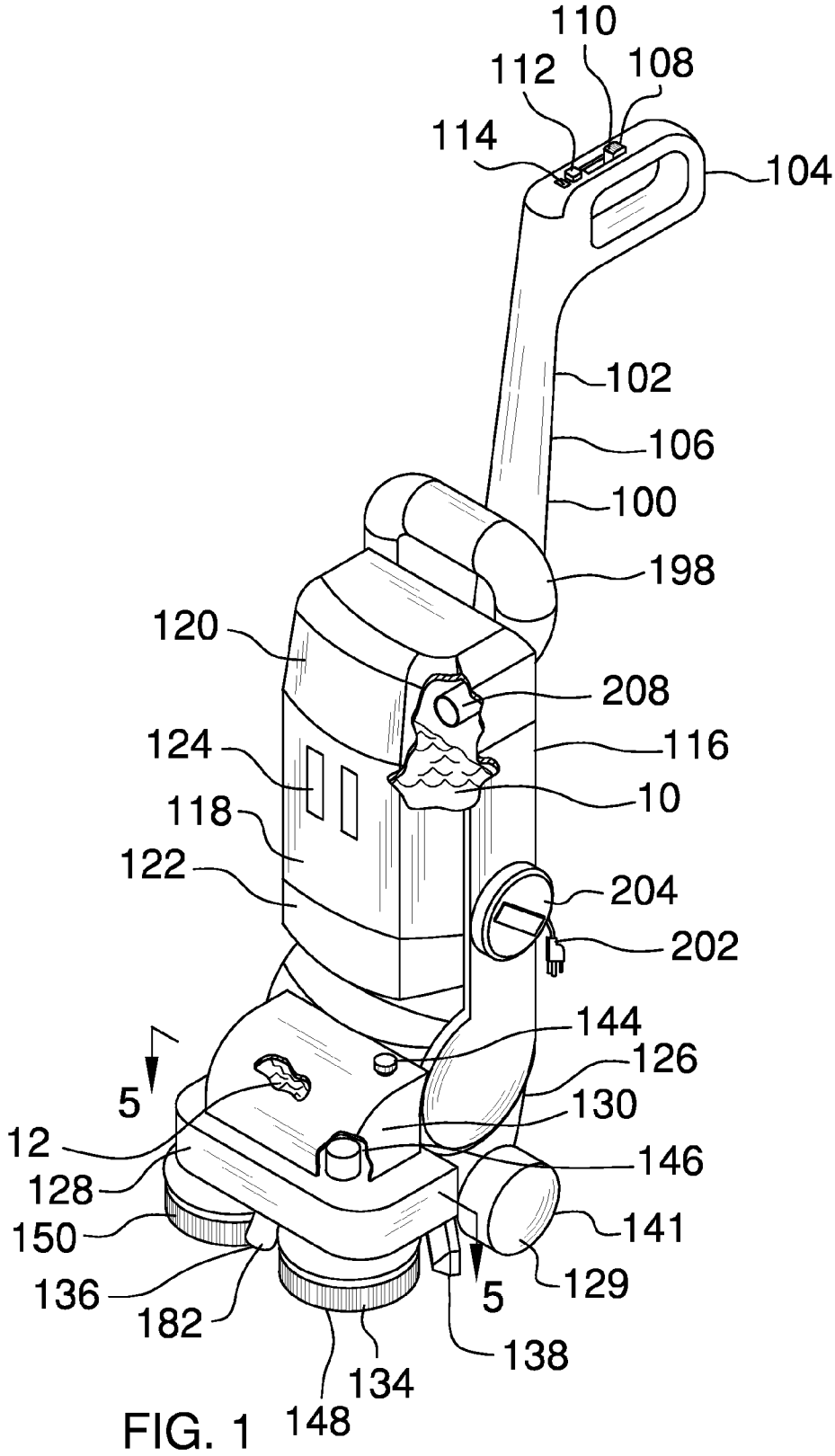
FIG. 1 is an isometric view of a cleaner 100.
Figure 2:
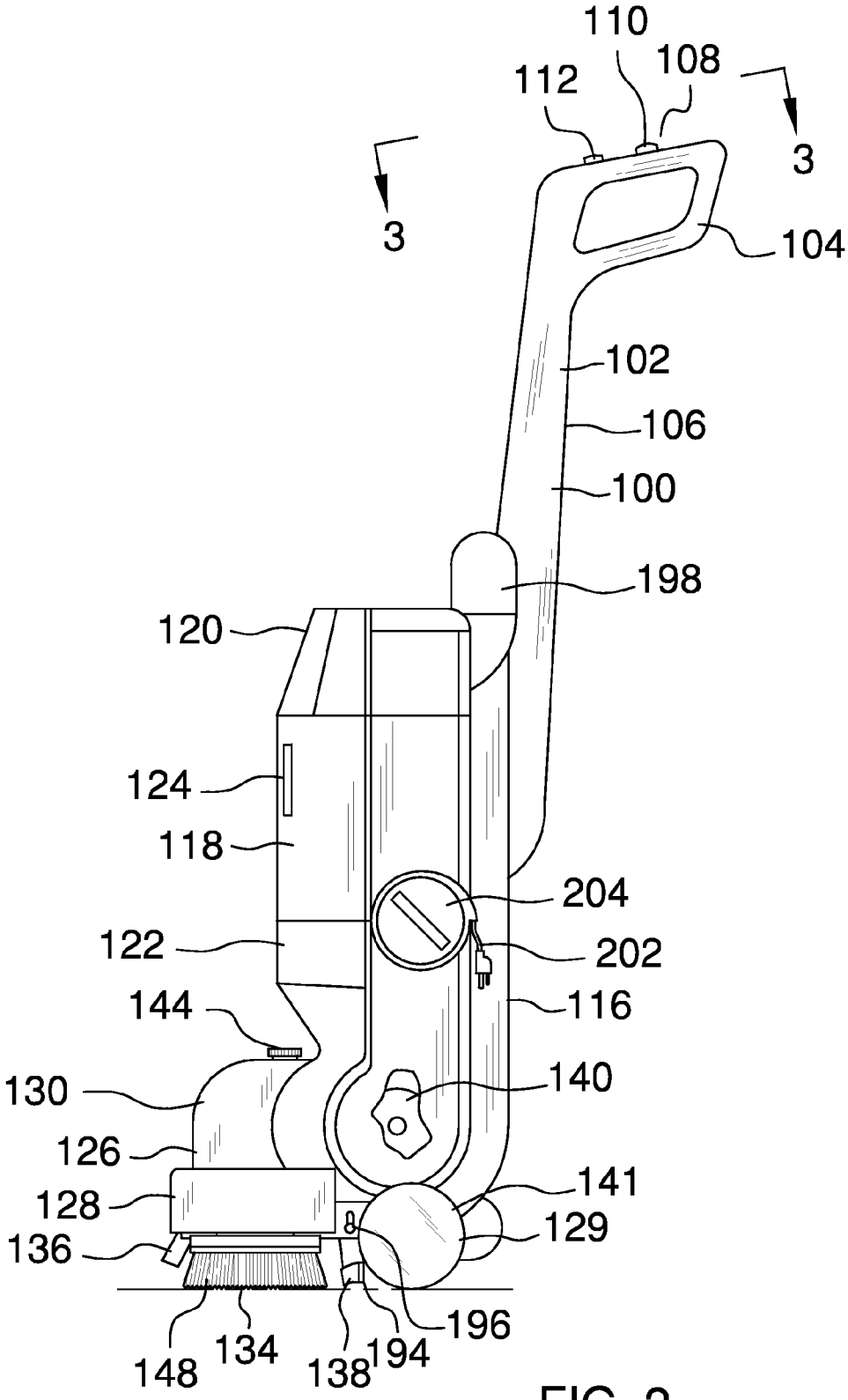
FIG. 2 is a left side view of cleaner 100.

FIG. 1 is an isometric view of a cleaner 100. FIG. 2 is a left side view of cleaner 100. Cleaner 100 may be an electrical appliance device that may utilize brushes and solution to clean a floor and a fan motor to create a partial vacuum to suck up dirt and dirty water from the floor. Cleaner 100 may clean wood, tile and grout, as well as carpet effectively. Cleaner 100 may be referred to as a vacuum cleaner with scrubbers. Cleaner 100 may include a handle assembly 102 having a handle 104 attached to a handle bar 106. Positioned on an upper surface of handle 104 may be controls 108.

Handle assembly 102 may include a group of parts that may fit together to allow a user to exercise control over cleaner 100 with the hands of that user. Handle 104 may be an appendage to handle assembly 102 that may be held to use and move cleaner 100. In one example, handle 104 may have an enclosed O-shaped loop configuration. Handle bar 106 may be an elongated rigid structure to elevate handle to a usable height (such as around four feet) and to connect handle 104 to a remainder of cleaner 100. Both handle 104 and handle bar 106 may be hollow to allow wires to run from controls 108 to elsewhere within cleaner 100.

Figure 3:
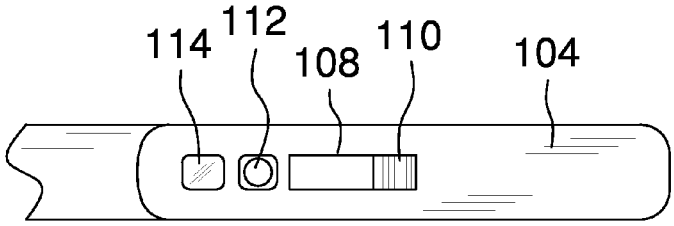
FIG. 3 is a partial top view of cleaner 100 illustrating controls 108.

FIG. 3 is a partial top view of cleaner 100 illustrating controls 108. Controls 108 may include a mode switch 110, a power switch 112, and a status light 114. Mode switch 110 may be a three-position thumb switch that may contribute to placing cleaner 100 into one of three different modes: a brush rotation mode, a suction mode, and a cleaning solution release mode. Cleaner 100 additionally may be in a plugged in but no action mode.

Power switch 112 may be a device to make or break the connections in a circuit. Here, power switch 112 may control an on/off flow of electricity through cleaner 100. Status light 114 may serve as a source of different colored illuminations, each of which may convey a state of cleaner 100. For example, a brown illumination may convey the brush mode, a green illumination may convey the suction mode, a yellow illumination may convey the solution release mode, and a red illumination may convey that the power switch is on, but no action mode has been selected. The lack of illumination from status light 114 may mean that cleaner 100 is not plugged in or that power is not reaching the power switch 112.

Cleaner 100 additionally may include an upright portion 116 having a dirty water reservoir 118 removeably connected to upright portion 116 between a dirty water reservoir cover 120 and a dirty water reservoir base 122. Dirty water reservoir 118 may be a repository for wastewater 10 (FIG. 1). Dirty water reservoir 118 may include dirty water reservoir handles 124 that may assist in removing and installing dirty water reservoir 118 from upright portion 116. Connected at a bottom of upright portion 116 may be a horizontal portion 126. Horizontal portion 126 may be configured to move back and forth across a floor. To assist in this, upright portion 116 may be configured to pivot relative to horizontal portion 126. Upright portion 116 may be attached to handle bar 106.

Figure 4:
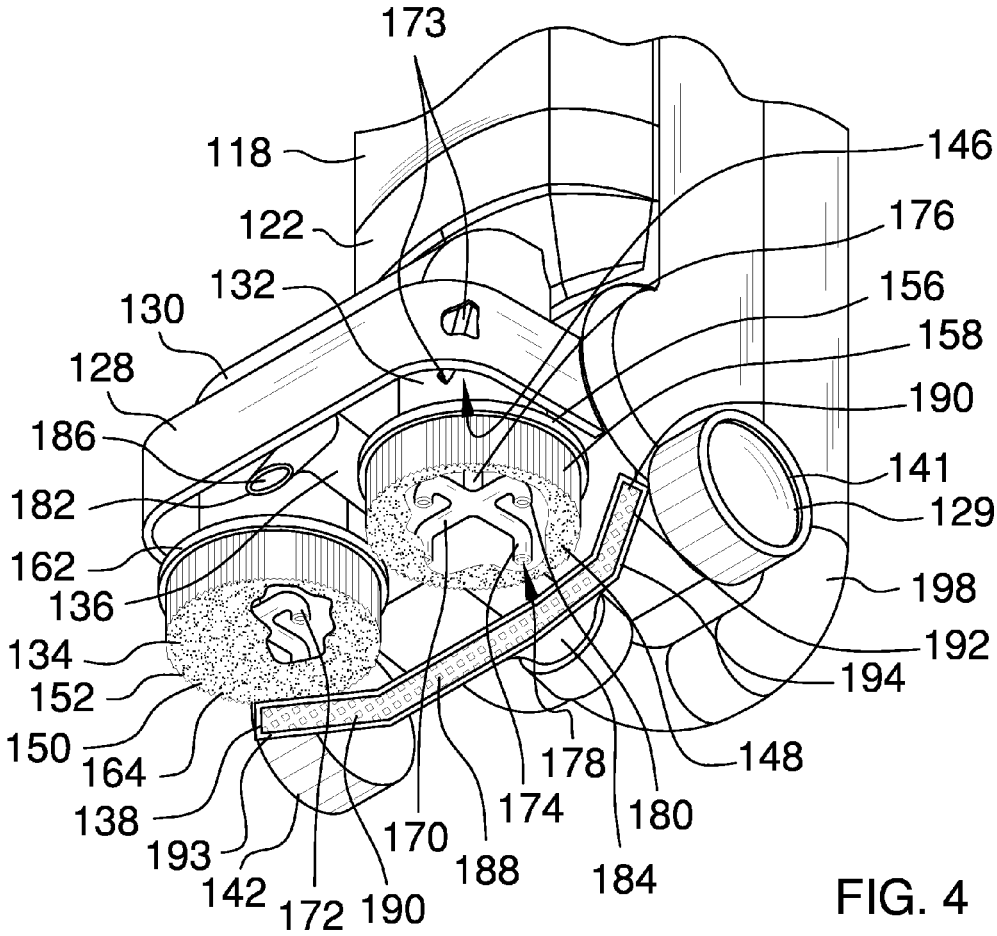
FIG. 4 is a partial isometric bottom view of cleaner 100 with elements removed for clarity.

FIG. 4 is a partial isometric bottom view of cleaner 100 with elements removed for clarity. Horizontal portion 126 may include a horizontal portion base 128, wheels 129, a solution reservoir 130, a brush motor 132 (FIG. 3), brushes 134, a suction pipe 136, a suction bar 138, and a fan motor 140 (FIG. 2). Wheels 129 may be attached to a rear of horizontal portion base 128 and solution reservoir 130 may be attached above horizontal portion base 128. Brushes 134 may be attached to brush motor 132, and brush motor 132, suction pipe 136, and suction bar 138 may be attached below horizontal portion base 128. Fan motor 140 may be positioned within upright portion 116 above wheels 129 and adjacent to solution reservoir 130.

Horizontal portion base 128 may be a foundation to support other elements of cleaner 100. Wheels 129 may include circular frames that may rotate on shafts attached to horizontal portion 128. Attached to horizontal portion base 128 may be a left wheel 141 and a right wheel 142 each of which may assist in moving cleaner 100.

Solution reservoir 130 may be a repository for cleaning solution 12 (FIG. 1). Cleaning solution 12 may be clean water or may be clean water with a cleaning agent added. Solution reservoir 130 may include a cleaning solution cap 144 to close an opening in solution reservoir 130 and may include a brush motor cavity 146 formed within a lower side of solution reservoir 130. Brush motor cavity 146 may be a vertically orientated empty space surrounded by solution reservoir 130 that may be configured to receive brush motor 132. Solution reservoir 130 may be removeably attached to horizontal portion base 128 in front of upright portion 126 so that brush motor 132 resides within and may be surrounded by brush motor cavity 146. In this arrangement, cleaning solution 12 within solution reservoir 130 may serve to dampen noise from brush motor 132. In one example, brush motor cavity 146 may be part of solution reservoir 130, where solution reservoir 130 has a bottom surface separate from horizontal portion base 128. In another example, brush motor cavity 146 may be part of horizontal portion base 128 and solution reservoir 130 may utilize horizontal portion base 128 as a bottom surface to enclose solution reservoir 130. In this another example, clamps and a gasket may seal solution reservoir 130 to horizontal portion base 128.

Solution reservoir 130 may be formed to follow the contours above brushes 134 and be removeably position above brushes 134 and in front of fan motor 140. Importantly, solution reservoir 130 may be sized and contoured to dampen noise from brush motor 132 and fan motor 140. In one example, solution reservoir 130 may dampen noise from brush motor 132 approximately by at least fifty percent and dampen noise from fan motor 140 approximately by at least ten percent. In assembly, solution reservoir 130 may align with a cleaning solution path to brushes 134 and may be snapped into place.

Brush motor 132 may receive and respond to signals from controls 108 by converting electrical power into mechanical rotary motion. Brush motor 132 may be positioned within brush motor cavity 146 such that an axis of rotation of brush motor 132 may be vertically orientated. In one example, brush motor 132 may be a twelve-amp motor for which noise emanating from brush motor 132 may be muffled by brush motor cavity 146.

Brushes 134 may be removeably attached to horizontal portion 126 within horizontal portion base 128. Here, brushes 134 may be removable and snap fit into place with a ¼ turn in a direction opposite of its rotation path during operation of cleaner 100. Brushes 134 may include a left brush 148 and a right brush 150. Further, brushes 134 may include a set of wooden floor brushes 152 (FIG. 4) to clean wooden floors and a set of tile floor brushes 154 (FIG. 6) to clean tile floors.

Figure 5:
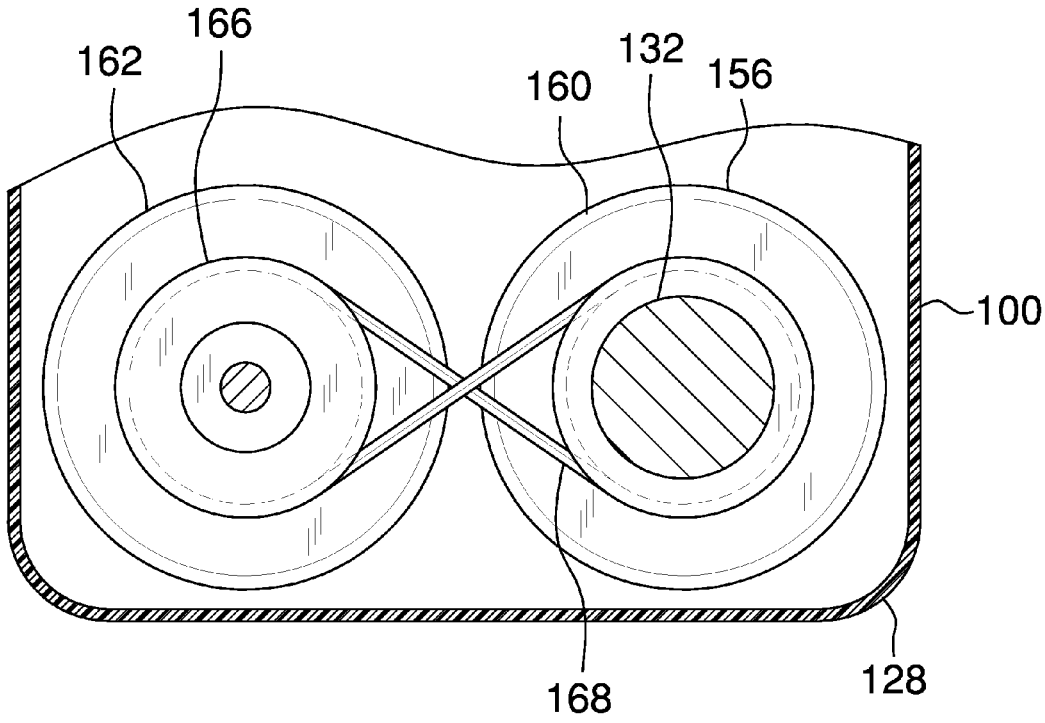
FIG. 5 is a top, partial section view of cleaner 100 generally taken off line 5-5 of FIG. 1.
Figure 6:
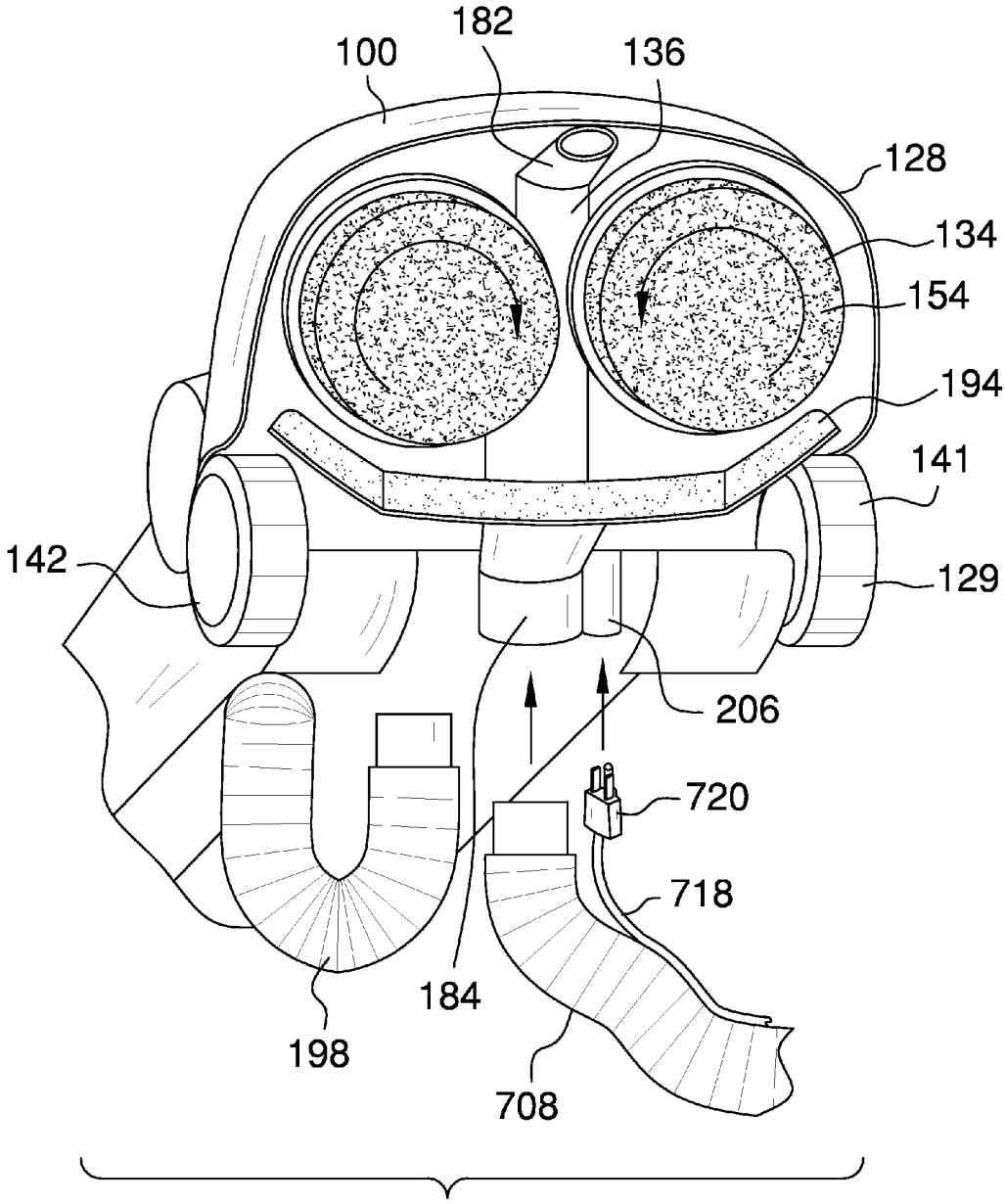
FIG. 6 is a bottom, isometric, exploded view of cleaner 100 with parts removed for clarity.

FIG. 5 is a top, partial section view of cleaner 100 generally taken off line 5-5 of FIG. 1. FIG. 6 is a bottom, isometric, exploded view of cleaner 100 with parts removed for clarity. Left brush 148 may include a left brush handle 156 (FIG. 4 and FIG. 5) attached to a left brush head 158 (FIG. 4). Left brush handle 156 may be removeably attached to brush motor 132, such as by a ball and detent mechanism. Brush motor 132 may rotate left brush handle 156 directly. Attached adjacent to left brush handle 156 may be a drive pulley wheel 160 (FIG. 5). Drive pulley wheel 160 may be a wheel having a groove. Right brush 150 may include a right brush handle 162 attached to a right brush head 164. Right brush handle 162 may be removeably attached to horizontal portion base 128. Attached adjacent to right brush handle 162 may be a follow pulley wheel 166. Follow pulley wheel 166 may be a wheel having a groove.

Cleaner 100 additionally may include a belt 168 (FIG. 5). Belt 168 may be an endless loop of flexible material twisted once over itself and position between drive pulley wheel 160 and follow pulley wheel 166. Belt 168 may transfer rotary motion from brush motor 132 to right brush 150. The twist in a middle of belt 168 may cause left brush 148 and right brush 150 to rotate towards suction pipe 136 to draw dirty water inward and towards suction bar 138.

Wooden floor brushes 152 may have a different scrubbing texture head than those of tile floor brushes 154. Left brush head 158 and right brush head 164 of wooden floor brushes 152 may be configured to scrub wood floors. Wooden floor brushes 152 may have a buffer type head (cleaning pad) for wood floors, such as including a tangled bundle of strands of very fine soft nylon filaments. Left brush head 158 and right brush head 164 of tile floor brushes 154 may be configured to scrub tiles and grout such as by using short stiff bristles.

Cleaner 100 additionally may include a left dispenser 170 (FIG. 4) positioned within left brush head 158 and a right dispenser 172 positioned within right brush head 164. Right dispenser 172 may have a similar construction as left dispenser 170 and each may be connected to solution reservoir 130 by tubing as a small hose connected from solution reservoir 130 to horizontal portion base 128. Here, the cleaning solution pipe/path may run from solution reservoir 130 to left brush 148 and right brush 150. This may communicate cleaning solution 12 from solution reservoir 130 through and out right brush head 164 and left brush head 158, respectively. Cleaner 100 additionally may include a front dispenser 173 (FIG. 4) at a front of cleaner 100 attached to this tubing.

Left dispenser 170 may include nozzles 174 attached to a left dispenser tube 176, each of which may surround a left dispenser hollow passageway 178. Left dispenser hollow passageway 178 may be an open channel within which cleaning solution 12 may flow. In one example, left dispenser 170 may include four nozzles 174, each having a vertically orientated opening 180 radially and evenly distributed about left dispenser tube 176. Left dispenser 170 may rotate with left brush 148.

Cleaning solution 12 may be released from a center of each brush 134. Nozzles 174 may have a plus-shape to dispense cleaning solution 12 into each brush 134 from four openings 180 positioned remote from each other opening 180. Moving mode switch 110 to a solution release position may cause cleaning solution 12 to be released into each brush 134 through nozzles 174 so that cleaning solution 12 enters each brush 134 from the four exits of the plus-shape nozzles 174. Cleaning solution 12 also may be released from a front of cleaner 100 down an interior side of horizontal portion base 128 near brush motor 132.

Solution reservoir 130 may be triggered by signals from controls 108 by releasing cleaning solution 12 through a signal controlled one-way valve. Cleaning solution 12 may leave cleaner 100 from each center of left brush 148 and right brush 150 and from a front of cleaner 100. With cleaning solution 12 being dispense onto a floor and brushes 134 scrubbing that floor with cleaning solution 12, it may be desirable to remove the dirt and dirty water mixture created by this process. Here suction pipe 136 and suction bar 138 may work together to assist cleaner 100 in removing this dirt and dirty water.

Suction pipe 136 may be a hollow passageway to convey a vacuum that may draw dirt and dirty water into suction pipe 136. Suction pipe 136 may be attached to horizontal portion 126 within horizontal portion base 128, between left brush 148 and right brush 150, and above left brush handle 156 and right brush handle 162. Suction pipe 136 may include a suction nozzle 182 at one end and a hose receiver 184 (FIG. 6) at an opposite end.

Suction nozzle 182 may be a hollow passageway angled downward from a remainder of suction pipe 136. Suction nozzle 182 may be positioned forward of brushes 134 (as in FIG. 2) such that an oval opening 186 (FIG. 4) of suction nozzle 182 resides ahead of brushes 134. Hose receiver 184 may be an adapter to receive a hose.

Suction bar 138 may be a hollow passageway having a suction bar rectangular section 188 (FIG. 4) positioned between two angled forward sections 190. Suction bar 138 may be positioned within horizontal portion base 128 behind brushes 134. Suction bar 138 may have a suction bar rear 192 at a trailing end of suction bar 138 and a suction bar bottom 193 at a lowermost point of suction bar 138. Suction bar 138 may be attached to suction pipe 136 so that any vacuum drawn in suction pipe 136 may be drawn in suction bar 138. Suction bar bottom 193 may reside above a bottom of wheels 129 and brushes 134.

Cleaner 100 additionally may include a squeegee 194 attached to a squeegee moving mechanism 196 (FIG. 2) against suction bar rear 192 along the entire length of suction bar rear 192. Squeegee 194 may be a flat, smooth rubber blade, used to control the flow of liquid on a floor beneath cleaner 100. While suction bar 138 may remain stationary, squeegee moving mechanism 196 may be a device to move squeegee 194 up and down relative to suction bar 138.

In one example, squeegee moving mechanism 196 may be configured to lower squeegee 194 pneumatically when suction is applied to suction pipe 136 and may be spring biased to raise squeegee 194 up when no suction is applied. In another example, squeegee moving mechanism 196 may include a lever that may be configured to pivot about a fulcrum to move squeegee 194 up and down mechanically. Squeegee moving mechanism 196 may lower squeegee 194 to run along the ground and may raise squeegee 194 above suction bar bottom 193.

Brushes 134 may be utilized to agitate a dirty carpet. Here, the spinning of brushes 134 and application of cleaning solution 12 to the dirty carpet may clean the carpet. Squeegee 194 may draw the dirty water in the carpet towards suction bar 138, where suction bar 138 may draw up the dirty water so that it may be placed in dirty water reservoir 118. Brushes 134 may include a third set of brushes to clean carpet where this third set of brushes may have a scrubbing texture head that may be different than the scrubbing texture head of wooden floor brushes 152 and tile floor brushes 154.

Fan motor 140 (FIG. 2) may be a device to convert electrical power into rotary motion. Fan motor 140 may be responsive to signals from controls 108 to create rotary motion to turn a fan wheel that may draw a vacuum in both suction pipe 136 and suction bar 138. With suction nozzle 182 positioned forward of brushes 134 and suction bar 138 positioned behind brushes 134, any liquid and dirt in front and behind left brush 148 and right brush 150 may be drawn into suction pipe 136 by the vacuum created by fan motor 140.

Cleaner 100 additionally may include a cleaner hose 198, a cleaner power cord 202, a cleaner power cord retractor 204, and a cleaner electrical socket 206 (FIG. 6). Cleaner hose 198 may connect between cleaner hose receiver 184 (FIG. 6) and dirty water reservoir 118 (FIG. 1). Cleaner power cord 202 may connect to controls 108, brush motor 132, fan motor 144, and cleaner electrical socket 206 through cleaner power cord retractor 204. Cleaner power cord retractor 204 may be attached to upright portion 116. Cleaner electrical socket 206 may be attached to horizontal portion 126 adjacent to cleaner hose receiver 184.

Cleaner hose 198 may be a flexible, hollow tube to carry vacuumed liquid and dirt to be guided from suction pipe 136 into dirty water reservoir 118 through a removable cleaner hose exit 208 (FIG. 1). Cleaner power cord 202 may be a cord or cable to connect a cleaner 100 to an electrical power source temporarily. Cord retractor 204 may be a device to wind up cleaner power cord 202 when not in use. Cleaner electrical socket 206 may be a female electrical connector having slots or holes to accept the pins or blades of a male power plug and to deliver electricity to the male power plug.

Figure 7:
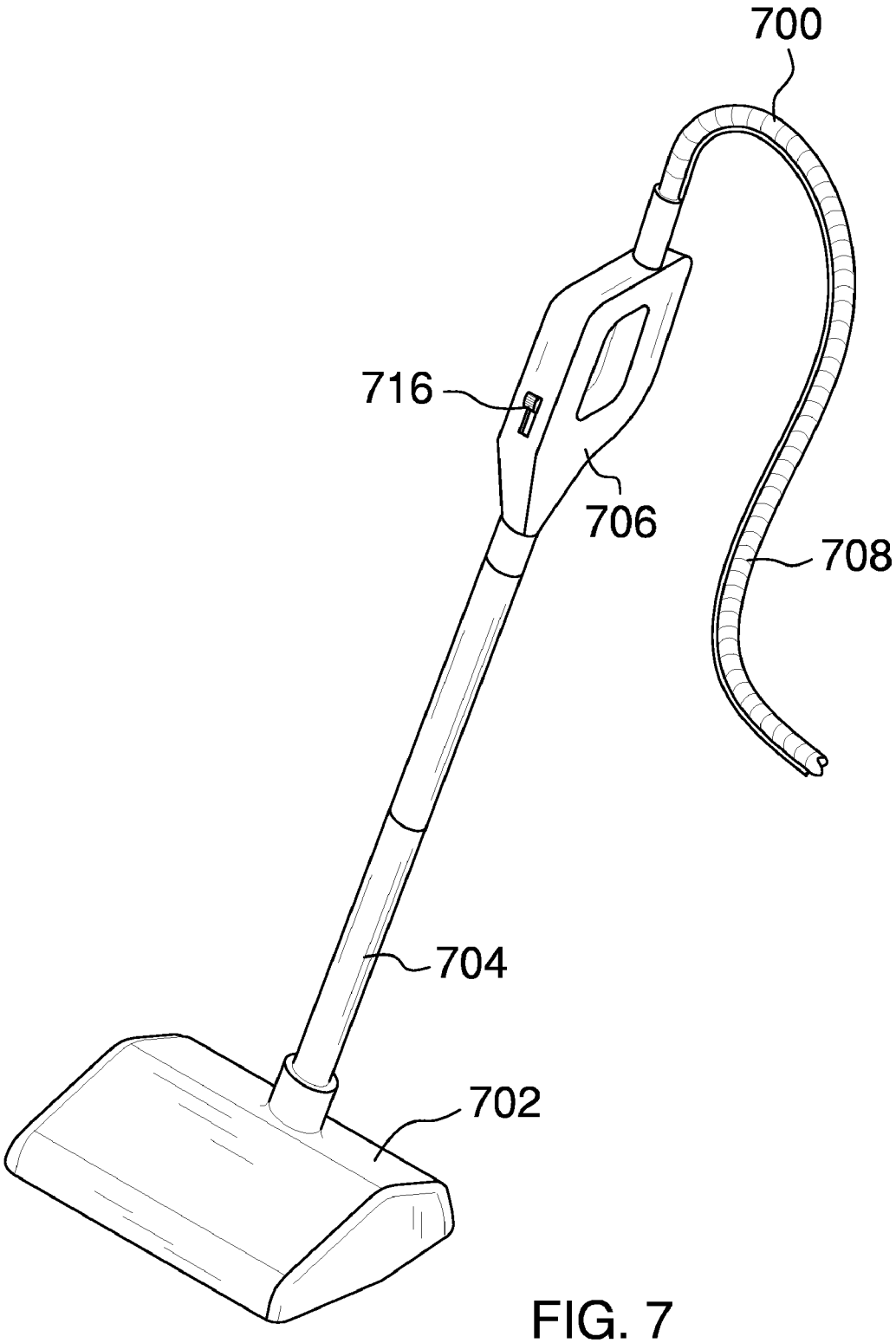
FIG. 7 is an isometric view of carpet attachment 700.
Figure 8:
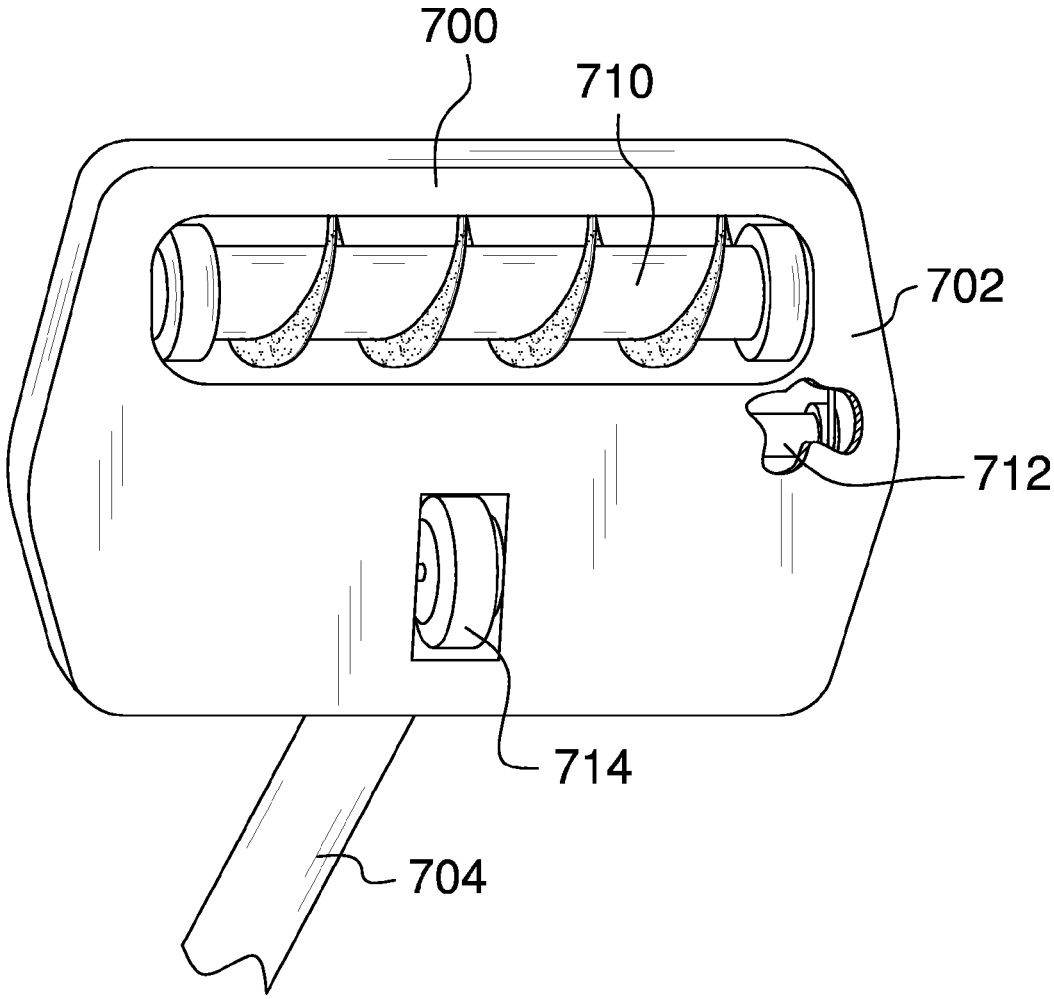
FIG. 8 is an isometric bottom view of carpet attachment 700.

Cleaner 100 may include a carpet attachment 700. FIG. 7 is an isometric view of carpet attachment 700. FIG. 8 is an isometric bottom view of carpet attachment 700.

Carpet attachment 700 may be an extension device to attach to cleaner 100 to clean carpets. Carpet attachment 700 may include a carpet attachment head 702, a rigid attachment tube 704, a carpet attachment handle 706, and a carpet attachment hose 708. Carpet attachment hose 708 may be connected to carpet attachment handle 706. Carpet attachment head 702 may be attached to rigid attachment tube 704 and rigid attachment tube 704 may be attached to carpet attachment handle 706.

Connected to carpet attachment head 702 may be an agitator 710, an agitator motor 712 to drive agitator 710, and a carpet attachment wheel 714. Carpet attachment handle 706 may include a carpet attachment power switch 716 and a carpet attachment power cord 718 may be connected along carpet attachment hose 708 to carpet attachment power switch and agitator motor 712. Attached to an end of carpet attachment power cord 718 may be a carpet attachment male power plug 720.

In assembly, cleaner hose 198 (FIG. 6) may be removed from cleaner hose receiver 184 and carpet attachment hose 706 may be inserted into cleaner hose receiver 184. In addition, carpet attachment male power plug 720 may be inserted into cleaner socket 206 to receive power from cleaner 100. Power may flow through carpet attachment power cord 718 to agitator motor 712 (FIG. 8) to rotate agitator 710 and brush a carpet.

The cleaner may be a vacuum cleaner that may clean tile and grout, as well as carpet that may save users time and energy while cleaning the house. The cleaner may include a clean water and solution reservoir, a motor housing, a removable suction hose, an adjustable front wheel (depending on floor type and brush), removable brush pads for tile and hardwood, an adjustable squeegee that may lower when suction may be applied, a dirty water reservoir, a retractable power cord, and an ergonomically designed handle. The handle may feature a three-way thumb switch for activating the brushes, suction, solution release, and on/off switch.

For use, cleaning solution may be sprayed onto the floor via a switch. The counterclockwise motor may spin the bristles and cleaning pad while the squeegee and the wet/dry vacuum may soak up the excess water and dirt into the dirty water reservoir. Both the clean and dirty water containers may be detachable for easy cleaning.

The cleaner may save individuals time and energy while clearing the home. The cleaner may clean tile, hardwood, and grout, as well as carpeting and rugs. Appealing features of the cleaner may be its multi-functional design, savings of time, energy-savings, cost-savings, portability, lightweight, convenience, ease of use, effectiveness, novel design, durability, and practicality.

Brushes may be removable interchangeable to allow different brush texture for wooden floors and tiles. The cleaner may include brush sets with different brush texture, one kind for wooden floors and another texture for tiles and grout. If the pads where to be use on carpet to agitate dirty carpet it will still work, the spinning of the brushes and the cleaning solution may clean the carpets. When the squeegee may be moved over a vacuum area and suction portion of the unit, it may suck up excess water and solution and dispose of it in a dirty water reservoir.

There may be one motor for two brushes with a belt twisted to transfer motion to other brush mechanism. The clean water solution reservoir may be located on a base of the cleaner and the dirty water reservoir may be located on the handle. If the solution reservoir is triggered to release cleaning solution, the cleaning solution may be release from the center of each brush and from a front of the cleaner. There may be a small hose connected from the solution reservoir to the base and a trigger controlling a one-way valve.

The cleaner may serve as both a vacuum cleaner and mop. As well as vacuuming dirt and debris from carpets, the cleaner may also clean tile and hardwood floors. The cleaner may save individuals a considerable amount of time and energy while cleaning the home and may save them a considerable amount of money by eliminating the cost of separate appliances and cleaning tools. With the cleaner, a user may have greater control and maneuverability to more thoroughly dean rugs, carpets, hardwood, and tile.

The multi-functional elements of the cleaner may ease the task of cleaning various surfaces and may save users time and energy. The cleaner may provide the user with a more efficient method of removing stains from various materials. It may also prevent premature replacement purchases of carpets, rugs, tile, and hardwood, which may save a consumer a considerable amount of money. The cleaner may be easy to use, portable, durable, versatile, cost saving, reasonably priced, convenient, lightweight, adjustable, and timesaving. Professional cleaning personnel may also use it commercially.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. An electrical appliance device to scrub clean a floor using a cleaning solution and to collect resulting dirty water from the floor, the electrical appliance device comprising:

a handle assembly having a handle attached to a handle bar and controls attached to an upper surface of the handle;

an upright portion attached to the handle assembly and having a dirty water reservoir connected to the upright portion;

a horizontal portion connected at a bottom of the upright portion, where the horizontal portion includes a horizontal portion base, a solution reservoir attached above the horizontal portion base, brushes connected to a brush motor, where the brush motor, a suction pipe, and a suction bar are attached to the horizontal portion base, where the solution reservoir includes a brush motor cavity formed within a lower side of the solution reservoir, and where the solution reservoir is adjacent to both the horizontal portion base and the upright portion so that the brush motor resides within and is surrounded by the brush motor cavity;

a fan motor positioned within the upright portion; and a cleaner hose connected between the suction pipe and the dirty water reservoir.

2. The electrical appliance device of claim 1, where the suction bar is a hollow passageway connected to the suction pipe, and where the suction bar includes a suction bar rectangular section positioned between two angled forward sections.

3. The electrical appliance device of claim 2, where the horizontal portion includes wheels attached to a rear of the horizontal portion base, where the suction bar includes a suction bar rear at a trailing end of the suction bar and a suction bar bottom at a lowermost point of the suction bar, and where the suction bar bottom resides above a bottom of the wheels and the brushes.

4. The electrical appliance device of claim 2, further comprising:

a squeegee attached to a squeegee moving mechanism, where the squeegee is positioned against the suction bar rear along the length of the suction bar rear, and where the squeegee moving mechanism is configured to raise and lower the squeegee relative to the suction bar.

5. The electrical appliance device of claim 1, where the suction pipe is in fluid communication with the fan motor, where the suction pipe includes a suction nozzle at one end and a hose receiver at an opposite end, where the suction nozzle is a hollow passageway angled downward from a remainder of the suction pipe and is positioned forward of the brushes such that an opening of the suction nozzle resides ahead of the brushes.

6. The electrical appliance device of claim 1, where the suction pipe is attached to the horizontal portion, within the horizontal portion base, between the left brush and the right brush, and above a left brush handle and a right brush handle.

7. The electrical appliance device of claim 1, where the brush motor cavity is a vertically orientated empty space surrounded by the solution reservoir that is configured to surround and contain and the brush motor.

8. The electrical appliance device of claim 1, where the brush motor is configured to receive and respond to signals from the controls and is positioned within the brush motor cavity such that an axis of rotation of the brush motor is vertical.

9. The electrical appliance device of claim 1, where the brushes includes a first set of brushes for wooden floors and a second set of brushes for tile floors, where one of the first set and second set of brushes is attached to the horizontal portion, and where the first set of brushes have a scrubbing texture head that is different than a scrubbing texture head of the second set of brushes.

10. The electrical appliance device of claim 9, where the scrubbing texture head of the second set of brushes includes stiff bristles.

11. The electrical appliance device of claim 1, where the brushes includes a left brush and a right brush, where the left brush includes a left brush handle attached to a left brush head, where the left brush handle is attached directly to the brush motor.

12. The electrical appliance device of claim 11, where the right brush includes a right brush handle attached to a right brush head, where a drive pulley wheel is attached above the left brush handle and a follow pulley wheel is attached above the right brush head, and where a belt is positioned between the drive pulley wheel and the follow pulley wheel.

13. The electrical appliance device of claim 12, where the belt includes one twist that causes the belt to cross over itself.

14. The electrical appliance device of claim 1, where the brushes includes a left brush having a left dispenser positioned within the left brush and a right brush having a right dispenser positioned within the right brush, and where the left dispenser and the right dispenser are in fluid communication with the solution reservoir.

15. The electrical appliance device of claim 14, where the left dispenser includes four nozzles attached to a left dispenser tube, where each of the four nozzles includes a vertically orientated opening and are radially and evenly distributed about the left dispenser tube.

16. The electrical appliance device of claim 1, further comprising:

a front dispenser in fluid communication with the solution reservoir, where the front dispenser is attached to the horizontal portion base and is configured to dispense cleaning solution in front of the brushes, and where the suction bar is positioned within the horizontal portion base behind the brushes.

17. The electrical appliance device of claim 1, where the upright portion is configured to pivot relative to the horizontal portion, where the upright portion attached to the handle assembly and having a dirty water reservoir is removeably connected to upright portion, where the solution reservoir is removeably attached to the horizontal portion base in front of and adjacent to the fan motor, where the horizontal portion includes wheels attached to a rear of the horizontal portion base, where the wheels include a left wheel and a right wheel, where the fan motor is positioned above the wheels and adjacent to the solution reservoir, where the controls include a mode switch, a power switch, and a status light, where the mode switch is a three position thumb switch, and where the solution reservoir includes a cleaning solution cap to close an opening in the solution reservoir.

* * * * *